US006193234B1

(12) United States Patent
Jones

(10) Patent No.: US 6,193,234 B1
(45) Date of Patent: Feb. 27, 2001

(54) METHOD FOR PLAYING A PUZZLE GAME

(76) Inventor: Richard D. Jones, 3537 Suncrest Ave., Yorktown, NY (US) 10598

( * ) Notice: Subject to any disclaimer, the term of this patent is extended or adjusted under 35 U.S.C. 154(b) by 0 days.

(21) Appl. No.: 09/362,879

(22) Filed: Jul. 29, 1999

Related U.S. Application Data

(60) Provisional application No. 60/094,808, filed on Jul. 31, 1998.

(51) Int. Cl.[7] ..... A63F 9/10
(52) U.S. Cl. ..... 273/157 R
(58) Field of Search ..... 273/157 R, 156, 273/153 R, 440, 446

(56) References Cited

U.S. PATENT DOCUMENTS

| | | | | |
|---|---|---|---|---|
| 2,482,109 | | 9/1949 | Grace . | |
| 3,010,723 | | 11/1961 | Moss . | |
| 3,542,368 | | 11/1979 | Ashley . | |
| 3,558,136 | | 1/1971 | McFarland . | |
| 3,909,003 | * | 9/1975 | Rabinovich | 273/157 R |
| 4,133,538 | * | 1/1979 | Ambrose | 273/157 R |
| 4,219,194 | | 8/1980 | Power . | |
| 4,669,734 | | 6/1987 | Watkins . | |
| 4,756,533 | | 7/1988 | Hopkins . | |
| 4,792,138 | | 12/1988 | Watkins . | |
| 5,062,637 | | 11/1991 | Bianchi . | |
| 5,123,846 | * | 6/1992 | Lewis | 273/157 R |
| 5,149,098 | | 9/1992 | Bianchi . | |
| 5,301,953 | * | 4/1994 | Levin | 273/157 R |

FOREIGN PATENT DOCUMENTS

| | | |
|---|---|---|
| 2 259 632 | 8/1975 | (FR) . |
| 2 382 252 | 9/1978 | (FR) . |
| 127 197 | 5/1919 | (GB) . |
| 424 772 | 2/1935 | (GB) . |
| 553 798 | 6/1943 | (GB) . |
| 604 175 | 6/1948 | (GB) . |
| 919 376 | 2/1963 | (GB) . |
| 2 069 851 | 9/1981 | (GB) . |
| 2 167 672 | 6/1986 | (GB) . |
| WO 86/04513 | 8/1986 | (WO) . |

* cited by examiner

*Primary Examiner*—Steven Wong
(74) *Attorney, Agent, or Firm*—Richard C. Litman

(57) ABSTRACT

A method of playing a puzzle game. The first step of the method is to jointly place outer puzzle pieces inside of a puzzle frame. Next, a single player may spin a spinner to randomly define how many inner puzzle pieces that player may take to complete an inner region of a puzzle. Afterwards, a stopwatch may be used to time how long the player takes to place as many inner puzzle pieces inside the puzzle frame as possible. After the player has completed an attempt at placing as many inner puzzle pieces as possible, the player's performance for the round is recorded on a score sheet for tracking that players performance during the life of the game. A puzzle game apparatus is also described which has a framed playing board, a jigsaw puzzle, a stopwatch, a spinner, and at least one score sheet.

14 Claims, 4 Drawing Sheets

METHOD FOR PLAYING A PUZZLE GAME

CROSS-REFERENCE TO RELATED APPLICATION

This application claims the benefit of U.S. Provisional Patent application Ser. No. 60/094,808, filed Jul. 31, 1998.

BACKGROUND OF THE INVENTION

1. Field of the Invention

The present invention relates generally to jigsaw puzzle games and, more particularly, to a method of playing a jigsaw puzzle game in which multiple players take turns attempting to assemble the puzzle game.

2. Description of Related Art

Various forms of board games have been devised over the years. Also, numerous form of jigsaw puzzles have been created. Board games are games typically played by two or more people. On the other hand, a jigsaw puzzle is typically assembled by a single person. Both board games and jigsaw puzzles present challenges to those who play them. Each may vary from the very simple to the incredibly complex. Each can provide minutes and hours of fun, enjoyment, and intrigue. But the attributes and capabilities associated with each has never been combined into a useful and fun puzzle game where two or more players can compete against each other under timed and scored conditions.

Several patents disclose puzzle games involving two or more players competing to complete a puzzle. For example, U.S. Pat. No. 3,558,136, issued on Jan. 26, 1971 to McFarland discloses a jigsaw puzzle game played by two opposing players or teams, each having identically cut and illustrated, but differently colored, pieces of a scene. Similarly, U.S. Pat. No. 5,062,637, issued on Nov. 5, 1991 to Bianchi discloses a method of playing a jigsaw board game with two players, wherein each player has a board, and all game pieces are piled on a playing table. However, neither patent discloses using a stopwatch or similar device for measuring how much time is used for placing puzzle pieces.

Further, U.S. Pat. No. 5,062,637 does not disclose a method of scoring for measuring a player's performance in placing puzzle pieces.

Additionally, few known U.S. patents anticipate use of a chance device with a conventional puzzle game. One such patent which does disclose use of a chance device is U.S. Pat. No. 3,542,368, issued on Nov. 24, 1979 to James N. Ashley. The Ashley patent discloses combining a jigsaw puzzle and bingo game that utilizes a chance device. However, a drawback of this patent is the absence of teaching regarding teams when playing the puzzle game. Another drawback is that this patent does not anticipate using a stopwatch for timing a player's performance in placing puzzle pieces.

A drawback of the known puzzle games is an absence of teams for fostering competition when playing a puzzle game. Another drawback of known puzzle games is an absence of time limits used in playing the game for tracking how much time is used to appropriately place puzzle pieces. Still another drawback of several puzzle games is an absence of scoring for tracking player performances in placing puzzle pieces. Yet another drawback of some common puzzle games is a failure to use chance devices for introducing chance into a puzzle game. Therefore, none of the above inventions and patents, taken either singly or in combination, is seen to describe the instant invention as claimed.

SUMMARY OF THE INVENTION

The present invention is a method of playing a puzzle game. The first step of the method is to jointly place outer puzzle pieces inside of a puzzle frame. Next, a single player may spin a spinner to randomly define how many inner puzzle pieces that player may take to complete an inner region of a puzzle. Afterwards, a stopwatch may be used to time how long the player takes to place as many inner puzzle pieces inside the puzzle frame as possible.

After the player has completed an attempt at placing as many inner puzzle pieces as possible, the player's performance for the round is recorded on a score sheet for tracking that players performance during the life of the game.

Accordingly, it is a principal object of the invention to provide a puzzle game that is played with two or more players. It is another object of the invention to provide a puzzle game played in teams. Still another object of the invention is to provide a puzzle game that is played with teams for introducing competition to the puzzle game. Yet another object of the invention is to provide a puzzle game involving use of a stopwatch for measuring the elapsed time used to place inner puzzle pieces.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
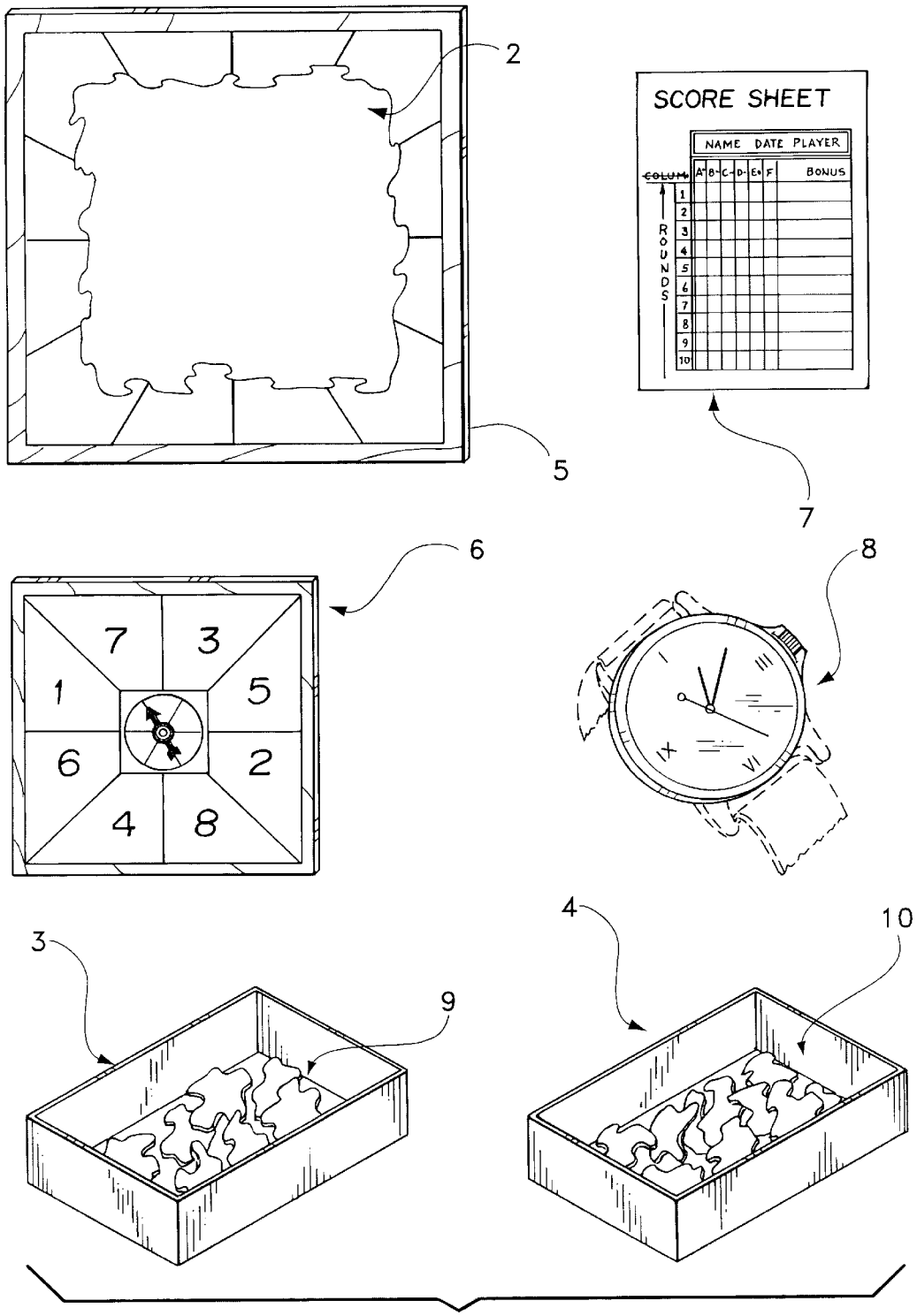
FIG. 1 is a diagrammatic view of the components of a puzzle game as used according to the present invention.

The present invention relates to a method of playing a puzzle game. FIG. 1 shows a diagrammatic view illustrating the components of a puzzle game according to the present invention. Preferably, the puzzle game has the following components: a framed playing board 2, a first box 3 and a second box 4, inner (or interior) puzzle pieces 10, outer (or edge) puzzle pieces 9, a spinner 6, a score sheet 7, and a stopwatch 8. The framed playing board 2 is used for defining an outer frame 5 against which the outer puzzle pieces 9 may be placed. The playing board 2 serves as a planar surface on which to assemble the inner and outer puzzle pieces. The stopwatch 8 serves to measure the elapsed time used by a player in a given round of the puzzle game for placing the inner puzzle pieces 10. The first box 3 and the second box 4 are used to separate and to randomly mix the outer puzzle pieces 9 and the inner puzzle pieces 10, respectively, prior to the start of play.

Figure 4:
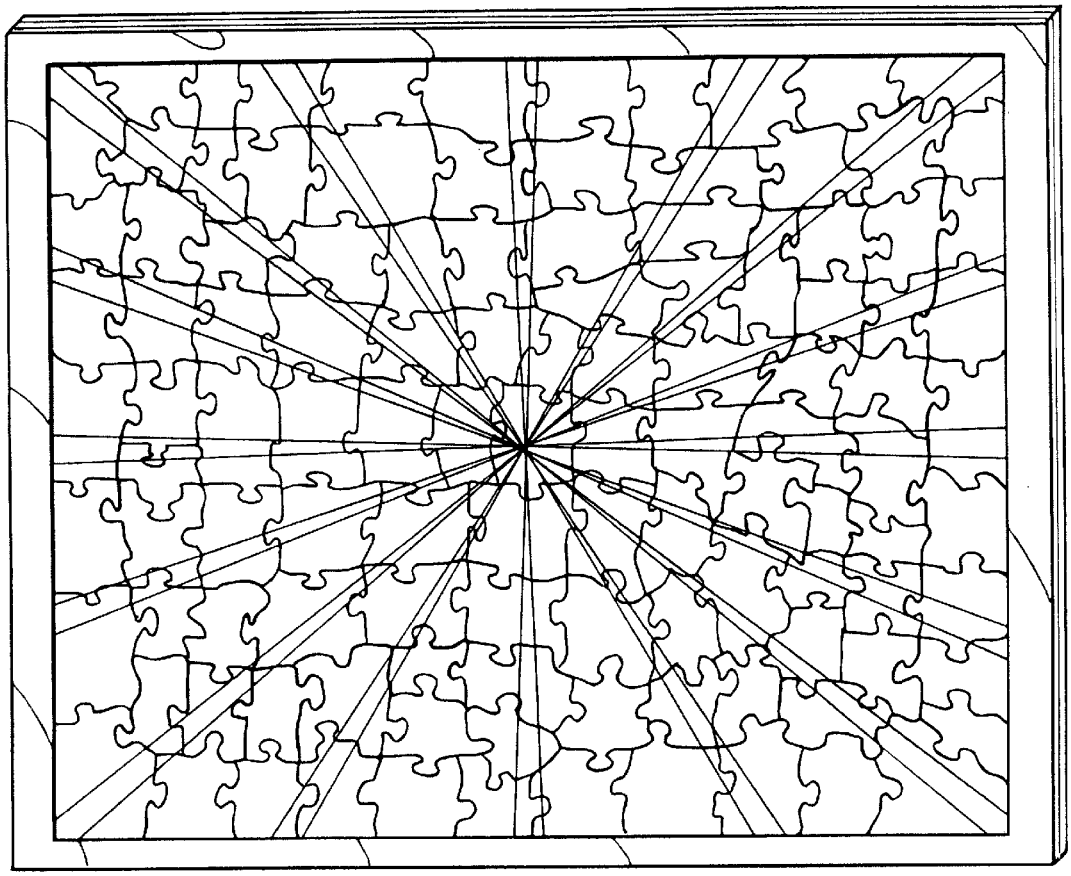
FIG. 4 is a plan view of a completed puzzle.

A completed puzzle image 12 is formed upon proper placement of all the puzzle pieces as illustrated in FIG. 4.

Figure 2:
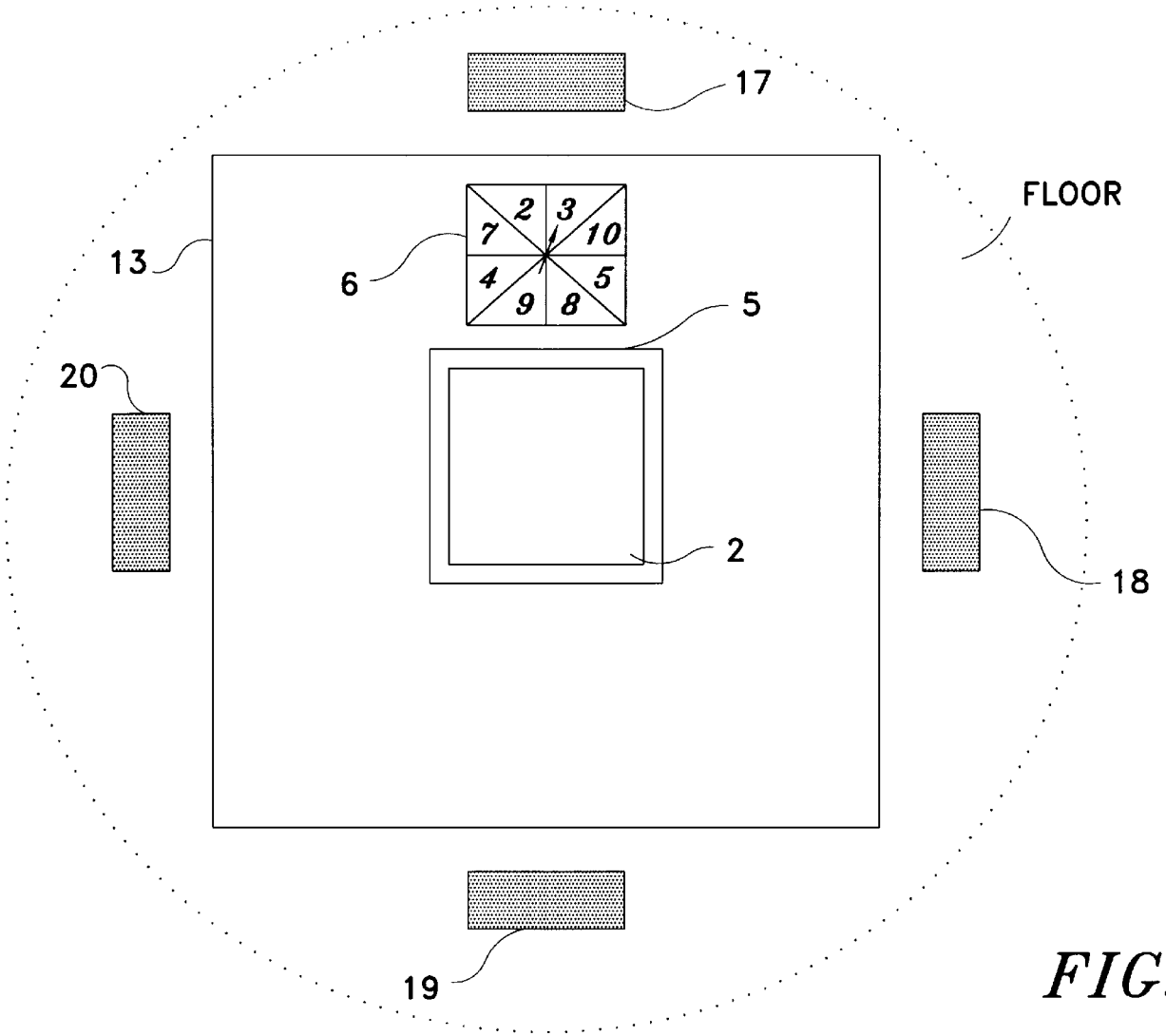
FIG. 2 is a plan view of a seating arrangement illustrating the step of sequentially assigning a number or letter designation to each player's position in the seating arrangement.

Preferably, the puzzle game is played with four or more players for enabling formation of teams of two or more persons. The puzzle game may be played on top of a table 13 or similar structure wherein each of the players can be seated evenly around the game for providing equal access to puzzle game components to all players. FIG. 2 illustrates a seating arrangement of four chairs around the table 13 for accomplishing this objective.

Before the start of the puzzle game, a sequence of preliminary steps are preferably performed for setting up the puzzle game. The first of these preliminary steps requires all players to agree on a time limit per round to be allowed for each player to place the inner puzzle pieces 10. This time limit serves to limit the amount of time that lapses while a particular player plays the puzzle game.

A sequence of additional preliminary steps may then be performed for establishing an order of rotation between players while playing the puzzle game. These additional preliminary steps may best be appreciated by referring to FIGS. 1 and 2. First, each player must individually spin the spinner 6. The player who spins the highest number, for example, the player in position 17 in FIG. 2, becomes the first player to play a round of the puzzle game. The remaining players will each individually play a round of the puzzle game after the first player has played in order of their seating positions as defined by a clockwise rotation around the table 13 starting from the first player, and thus the players in positions 18, 19, and 20, sequentially. If the highest number is spun by two or more players, those players spin again until one player obtains a higher number than the other players.

For identifying the players for scoring purposes, the players may be assigned a number or letter corresponding to the order of rotation of play, the player spinning the highest number and having the first turn at play being designated player "1" or player "A", the succeeding players being designated players "2", "3", etc. or "B", "C", etc., sequentially, in clockwise manner around the table 13, in accordance with the order of play.

Figure 3:
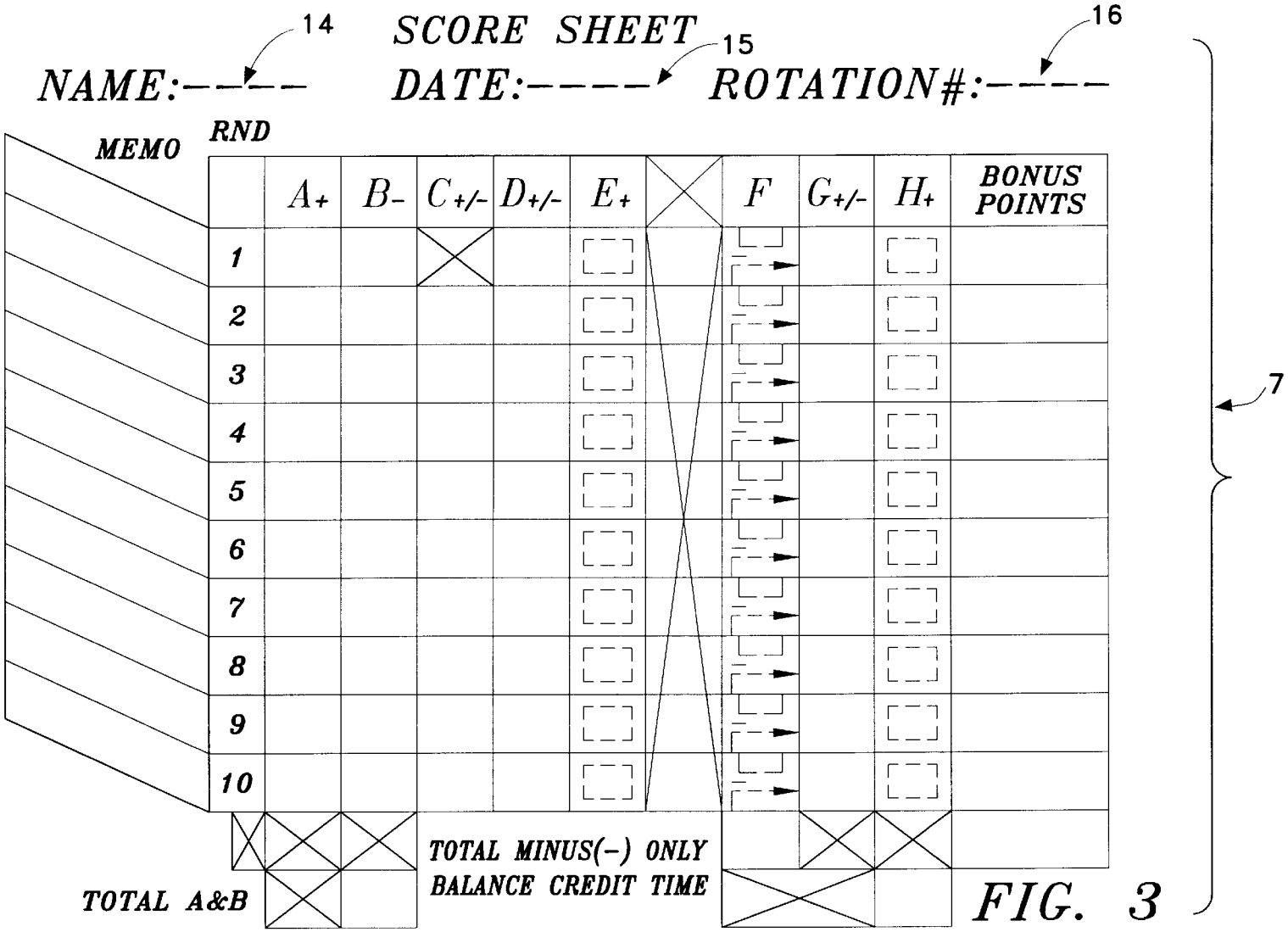
FIG. 3 is an enlarged plan view of a score sheet according to a preferred embodiment.

A preferred process for setting up a score sheet 7 according to the present invention will now be described. Each player will fill out a score sheet 7, such as that shown in FIG. 3, to be used by that player for tabulating a score for that player. Each score sheet 7 will initially be filled out by performing three steps. First, each player will write that player's name in the space 14 adjacent the word "NAME" on the score sheet 7 for identifying the player to which each score sheet belongs. Second, each player will then write a current date in the space 15 adjacent the word "DATE" on the score sheet 7 for documenting a current date. Third, each player will write in the space 16 adjacent the word "ROTATION" the number or letter of the alphabet that was assigned to that player for identifying that player's position in the order of rotation between players.

The puzzle game begins by all players jointly participating in assembling the outer puzzle pieces 9 inside the puzzle frame 5 for completing an outer region of the puzzle. This phase of the puzzle game is intended to promote team cooperation, not competition. Consequently, time spent placing the outer puzzle pieces 9 is not. monitored by the stopwatch 8.

After placement of all the outer puzzle pieces 9, the player selected to have the first turn, as described above, spins the spinner 6 to randomly define the number of inner puzzle pieces 10 that may be taken from the second box 4 during the first round of play. After spinning the spinner 6, the player records that number in the column labelled "A" on the score sheet 7. The player will then remove from the second box 4 a number of inner puzzle pieces 10 equal to the number to which the spinner 6 is pointed.

After the inner puzzle pieces 10 have been removed from the box 4 and the player is ready to proceed with the puzzle game, the stopwatch 8 is activated to begin measuring how much time the player uses in attempting to assemble as many of the removed inner puzzle pieces 10 as possible. When the stopwatch 8 reaches the maximum time limit, the stopwatch 8 is deactivated and the player must stop play for that round. Alternatively, when the player is satisfied that no more of the inner puzzle pieces 10 will fit into the puzzle, the player may say "Stop", the stopwatch 8 is stopped, and the player's turn terminates for that round of play.

The player then counts the number of inner puzzle pieces 10 successfully placed during that round and writes that number in the column labelled "B" on the score sheet 7. In the first round, the player may then assess the number of inner puzzle pieces 10 not successfully placed in that round and writes that number in the column labelled "D" of the score sheet 7 for recording the cumulative number of unplaced inner puzzle pieces 10. In subsequent rounds, the number of unplaced pieces for the round is recorded in column "C" of the score sheet 7, and added to the cumulative total from the prior round, the result being recorded in column "D". The total in column "D" is then copied to column "E" of the score sheet 7. Any unplaced inner puzzle pieces 10 are retained by each individual player in an unplayed puzzle piece area.

The first player then records the agreed upon time limit in the upper block of column "F" for the first round, his elapsed time as shown by the stopwatch 8 next to the minus sign, and any unelapsed time in the bottom block of column "F" for the first round. The unelapsed time is then copied into both column "G" and column "H" as carryover time for a purpose set forth below.

Play then continues sequentially through the remaining players in the order of rotation in the same manner, including spinning the spinner 6, removing the indicated number of unplayed puzzle pieces 10 from the second box 4, starting the stopwatch 8 for the predetermined length of time, assembling the unplayed pieces 10 on the puzzle board 2, stopping the stopwatch 8, and recording the pieces and times on the score sheet 7.

After the first round is completed, play continues for the second and subsequent rounds until the puzzle 12 is completely assembled, with the following modifications in play. Prior to the start of any given round, a player may request any carryover time he has accumulated in order to play any unplayed pieces 10 from his own unplayed piece area, in which case the amount of that player's carryover time from the previous round's column "H" on the score sheet 7 is added to the agreed upon time limit before starting the stopwatch 8. When scoring for a round, the cumulative total of unplayed pieces in column "E" for the previous round and the cumulative total of carryover time in column "H" for the previous round are both crossed out as the new cumulative totals are computed. When the second box 4 is empty of unplayed pieces 10, play continues with each player attempting to place any accumulated unplayed pieces 10 in his own area, first using any carryover time he has accumulated, and then for the agreed upon time limit, until the puzzle 12 is completely assembled.

Upon completion of play, each player may review his score sheet 7 to determine the total number of pieces assembled by adding the pieces recorded in column "B" and the total amount of time required to assemble the pieces by adding the times recorded adjacent the minus signs in column "F".

In the preferred embodiment, no winner or loser is declared, anyone making an attempt to play the game being deemed a winner. The score sheets 7 are deemed an evaluation sheet to determine the status of each player. However, it would be an obvious variation to declare the player who assembled the most pieces of the puzzle 12 in the shortest elapsed time "the winner". This may be determined either by dividing the number of seconds required to assemble the pieces by the total number of pieces assembled in order to obtain the number of seconds required to assemble each piece, or by dividing the number of pieces assembled by the time required to assemble the pieces in minutes in order to obtain the number of pieces assembled per minute.

Alternatively, a sequence of steps may be added to the method described above at any time prior to completion of the puzzle for permitting a player to win bonus points. Accordingly, anytime a player can identify the image of a completed puzzle during a particular round of play, that player may write the identity of the image and the applicable round number on the score sheet 7 for winning bonus points at the end of the game if that player correctly identified the image.

It is to be understood that the present invention is not limited to the sole embodiments described above, but encompasses any and all embodiments within the scope of the following claims.

I claim:

1. A method for playing a puzzle game involving the assembly of a jigsaw puzzle by a plurality of players, comprising the steps of:

a) agreeing upon a predetermined period of time for each player of a plurality of players to attempt the assembly of inner pieces of a jigsaw puzzle during a round of play;

b) determining a sequential order of play by the plurality of players;

c) providing a jigsaw puzzle having a plurality of outer pieces and a plurality of inner pieces, the outer pieces and inner pieces being disassembled and jumbled;

d) assembling the outer pieces of the jigsaw puzzle, the outer pieces being assembled by the plurality of players jointly;

e) selecting a number of pieces to be assembled by each player of the plurality of players in accordance with the sequential order of play;

f) timing the assembly of the inner pieces of the jigsaw puzzle by each individual player of the plurality of players in accordance with the sequential order of play;

g) recording, for each individual player of the plurality of players, the number of inner pieces of the jigsaw puzzle assembled by that player and the time required to assemble those pieces; and h) repeating steps (e), (f) and (g) until the jigsaw puzzle is completely assembled.

2. The method for playing a puzzle game according to claim 1, wherein the step of determining a sequential order of play by the plurality of players further comprises the steps of:

a) locating the plurality of players in a loop about a table;

b) spinning a pointer of a spinner having a random assortment of unique numbers about its periphery, each player of the plurality of players obtaining a number by spinning the spinner;

c) selecting the player who spun the highest number as the first player in the sequential order of play;

d) in case more than one player spins the highest number, repeating steps (b) and (c) in order to determine the first player in the sequential order of play; and (e) assigning the remaining players their position in the sequential order of play by clockwise rotation around the loop from the first player.

3. The method for playing a puzzle game according to claim 1, wherein the step of selecting a number of pieces to be assembled by each player of the plurality of players further comprises the step of spinning a pointer of a spinner having a random assortment of unique numbers about its periphery, the number of pieces being determined by the number pointed to.

4. The method for playing a puzzle game according to claim 3, wherein the step of selecting a number of pieces to be assembled by each player of the plurality of players further comprises the step of increasing the number of pieces to be assembled by a number of pieces left unassembled during prior rounds upon designation by the player.

5. The method for playing a puzzle game according to claim 1, wherein the step of timing the assembly of the inner pieces of the jigsaw puzzle further comprises the steps of:

a) providing a stopwatch;

b) setting the stopwatch to a time interval equal to the predetermined period of time as determined in step (a) prior to each player's turn;

c) starting the stopwatch; and d) stopping the stopwatch at the earliest of the predetermined period of time, the player's request to stop, and complete assembly of the jigsaw puzzle.

6. The method for playing a puzzle game according to claim 5, further comprising the step of increasing the time interval by any accumulated unused time from prior rounds upon request of a player having accumulated unused time.

7. The method for playing a puzzle game according to claim 1, wherein the step of recording the number of inner pieces of the jigsaw puzzle assembled and the time required to assemble those pieces further comprises the steps of:

a) recording the number of selected pieces left unassembled;

b) maintaining a cumulative record of pieces remaining unassembled;

c) maintaining a record of time from the time interval left unused during each round; and d) maintaining a cumulative record of the time left unused during successive rounds.

8. The method for playing a puzzle game according to claim 1, further comprising the step of assigning to each player in the sequential order of play a unique letter or number for identifying the player.

9. The method for playing a puzzle game according to claim 1, further comprising the steps of:

a) calculating, for each player, the number of inner pieces of the jigsaw puzzle assembled per unit of time; and b) declaring the winner to be the player assembling the most pieces per unit of time.

10. A method of playing a puzzle game for a plurality of players, the puzzle game including a jigsaw puzzle having a plurality of outer and inner pieces, clock means for measuring a time interval, chance means for determining a sequential order of play, and at least one score sheet for recording the performance of the plurality of players, said method comprising the steps of:

a) agreeing upon a predetermined period of time for each player of a plurality of players to attempt the assembly of inner pieces of said jigsaw puzzle during a round of play;

b) determining a sequential order of play by the plurality of players;

c) assembling the outer pieces of the jigsaw puzzle, the outer pieces being assembled by the plurality of players jointly;

d) selecting a number of pieces to be assembled by each player of the plurality of players in accordance with the sequential order of play;

e) timing the assembly of the inner pieces of the jigsaw puzzle by each individual player of the plurality of players in accordance with the sequential order of play;

f) recording, for each individual player of the plurality of players, the number of inner pieces of the jigsaw puzzle assembled by that player and the time required to assemble those pieces; and g) repeating steps (d), (e) and (f) until the jigsaw puzzle is completely assembled.

11. The method of playing the puzzle game according to claim 10, wherein the step of determining a sequential order of play by the plurality of players further comprises the steps of:

a) locating the plurality of players in a loop about a table;

b) using said chance means to determine the first player in the sequential order of play; and (c) assigning the remaining players their position in the sequential order of play by clockwise rotation around the loop from the first player.

12. The method of playing the puzzle game according to claim 10, wherein the step of selecting a number of pieces to be assembled by each player of the plurality of players further comprises utilizing said chance means in order to determine the number of pieces to be assembled.

13. The method of playing the puzzle game according to claim 10, wherein the step of timing the assembly of the inner pieces of the jigsaw puzzle further comprises the steps of:

a) starting said clock means to measure a time interval equal to a predetermined period of time prior to each player's turn; and b) stopping said clock means at the earliest of the predetermined period of time, the player's request to stop, and complete assembly of the jigsaw puzzle.

14. The method of playing a puzzle game according to claim 13, further comprising the step of increasing the time interval by any accumulated unused time from prior rounds upon request of a player having accumulated unused time.

* * * * *